US007226085B2

(12) United States Patent
Baker

(10) Patent No.: US 7,226,085 B2
(45) Date of Patent: Jun. 5, 2007

(54) GUARD FOR IN-LINE ROLLER SKATE

(76) Inventor: James Baker, 10 Moyse Drive, Courtice, Ontario (CA) L1E 2V4

( * ) Notice: Subject to any disclaimer, the term of this patent is extended or adjusted under 35 U.S.C. 154(b) by 0 days.

(21) Appl. No.: 11/332,267

(22) Filed: Jan. 17, 2006

(65) Prior Publication Data

US 2006/0157969 A1 Jul. 20, 2006

(30) Foreign Application Priority Data

Jan. 17, 2005 (CA) ..... 2492732

(51) Int. Cl.
*A63C 3/12* (2006.01)

(52) U.S. Cl. ..... 280/825; 280/809; 280/11.13; 280/811

(58) Field of Classification Search ..... 280/809–825, 280/11.13
See application file for complete search history.

(56) References Cited

U.S. PATENT DOCUMENTS

| | | | | |
|---|---|---|---|---|
| 4,364,187 | A * | 12/1982 | Melendez | 36/15 |
| 5,303,955 | A * | 4/1994 | Zurnamer | 280/825 |
| 5,398,970 | A * | 3/1995 | Tucky | 280/841 |
| 5,522,621 | A | 6/1996 | Schneider | |
| 5,573,275 | A | 11/1996 | Smith et al. | |
| 5,580,094 | A * | 12/1996 | Ruehlman et al. | 280/825 |
| 5,765,870 | A * | 6/1998 | Riley | 280/825 |
| 6,079,747 | A * | 6/2000 | Winsor | 280/825 |
| 6,481,724 | B1 * | 11/2002 | Whipp | 280/7.13 |
| 6,896,292 | B2 * | 5/2005 | Cuerrier | 280/825 |

FOREIGN PATENT DOCUMENTS

| | | |
|---|---|---|
| CA | 2142935 A1 | 2/1995 |
| CA | 2180694 A1 | 1/1997 |
| CA | 2176769 A1 | 11/1997 |
| CA | 2258290 A1 | 12/1997 |
| CA | 2448046 A1 | 5/2004 |

* cited by examiner

*Primary Examiner*—Christopher P. Ellis
*Assistant Examiner*—Cynthia F. Collado
(74) *Attorney, Agent, or Firm*—Birch, Stewart, Kolasch & Birch, LLP

(57) ABSTRACT

The guard is formed of moldable, flexible material and has a number of wheel-receiving wells formed in an in-line configuration in its upper wall. The forward and rear edges of each well are located high enough to prevent a wheel from rolling forward or rearward within the well. Laterally extending grooves are formed in the wells to minimize forward and backward movement of the wheels within the wells while the side walls of the wells contact the side walls of the wheels in order to minimize lateral movement.

5 Claims, 4 Drawing Sheets

GUARD FOR IN-LINE ROLLER SKATE

FIELD OF THE INVENTION

This invention relates to skate guards and more particularly to molded guards for use in conjunction with in-line roller skates.

BACKGROUND OF THE INVENTION

Guards which attach to in-line roller skates are known for making it possible to walk safely while wearing such skates. Such guards generally have channel-shaped body members which are attached beneath the skates by means of straps. The wheels of the skates are accommodated in the channels and are prevented from rolling by means of blocks which are positioned in front and behind each wheel.

Known guards have a number of shortcomings. Some such guards lack means for positively preventing them from moving relative to the skates. Slight movement between the skate and guard can be tolerated but significant movement can cause a wearer of the skate to lose his balance and fall. Other guards are suitable for use in conjunction with a very limited number of different sizes and shapes of skates. If a skate has a construction other than a conventional one, i.e. one where all of its wheels are of the same diameter and all of the wheels are spaced the same distance apart, the guard is not suitable for use with such a skate. If for example the skate is "rockered" i.e. where its wheels are of different diameters, such guards generally cannot be used.

Still other known guards for in-line roller skates have a number of adjustable components which must be re-set and tightened each time the guard is attached to a skate. After use, the components must loosened to allow the guard to be removed from the skate. Unless such measures are adhered to, the guard will not properly support the wearer of the skate when he is walking. Such guards require time and care to attach and remove and are inconvenient for that reason.

SUMMARY OF THE INVENTION

I have invented a guard for an in-line roller skate which obviates many of the disadvantages of known guards. Briefly, my guard comprises: a main body formed of a moldable material having oppositely facing upper and lower surfaces. The lower surface is adapted to contact the ground while the upper surface has a number of wheel-receiving wells which are formed in an in-line configuration. At least one of the wells has a wall for gripping a lower substantially continuous portion of the tread of a separate wheel of the skate. The tread-gripping wall is semi-circular throughout its length and commences at a forward edge, extends downwardly from the forward edge and terminates at a rear edge. The forward and rear edges are located such as to prevent the wheel from rolling forward or rearward within the well. The well further has upwardly extending side surfaces on opposite sides of the tread-gripping wall for contacting a lower portion of the side walls of the wheel in order to minimize lateral movement of the wheel relative to the main body. The guard has strap means for removably attaching the main body to the skate.

DESCRIPTION OF THE DRAWINGS

The guard of my invention is described with reference to the accompanying drawings in which.

Like reference characters refer to like parts throughout the description of the drawings.

DESCRIPTION OF PREFERRED EMBODIMENTS

Figure 1:
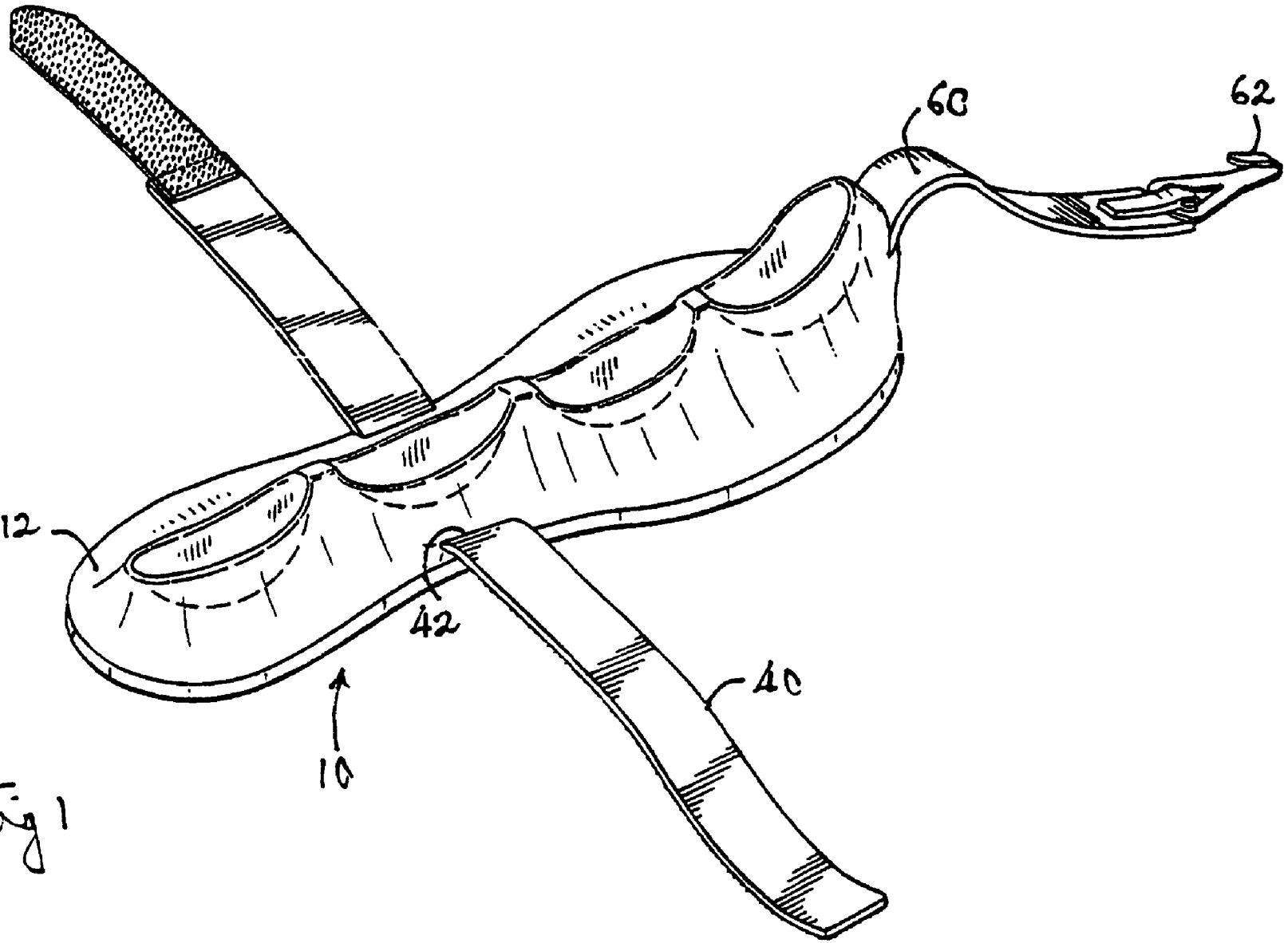
FIG. 1 is a perspective view of a body portion of the guard.
Figure 2:
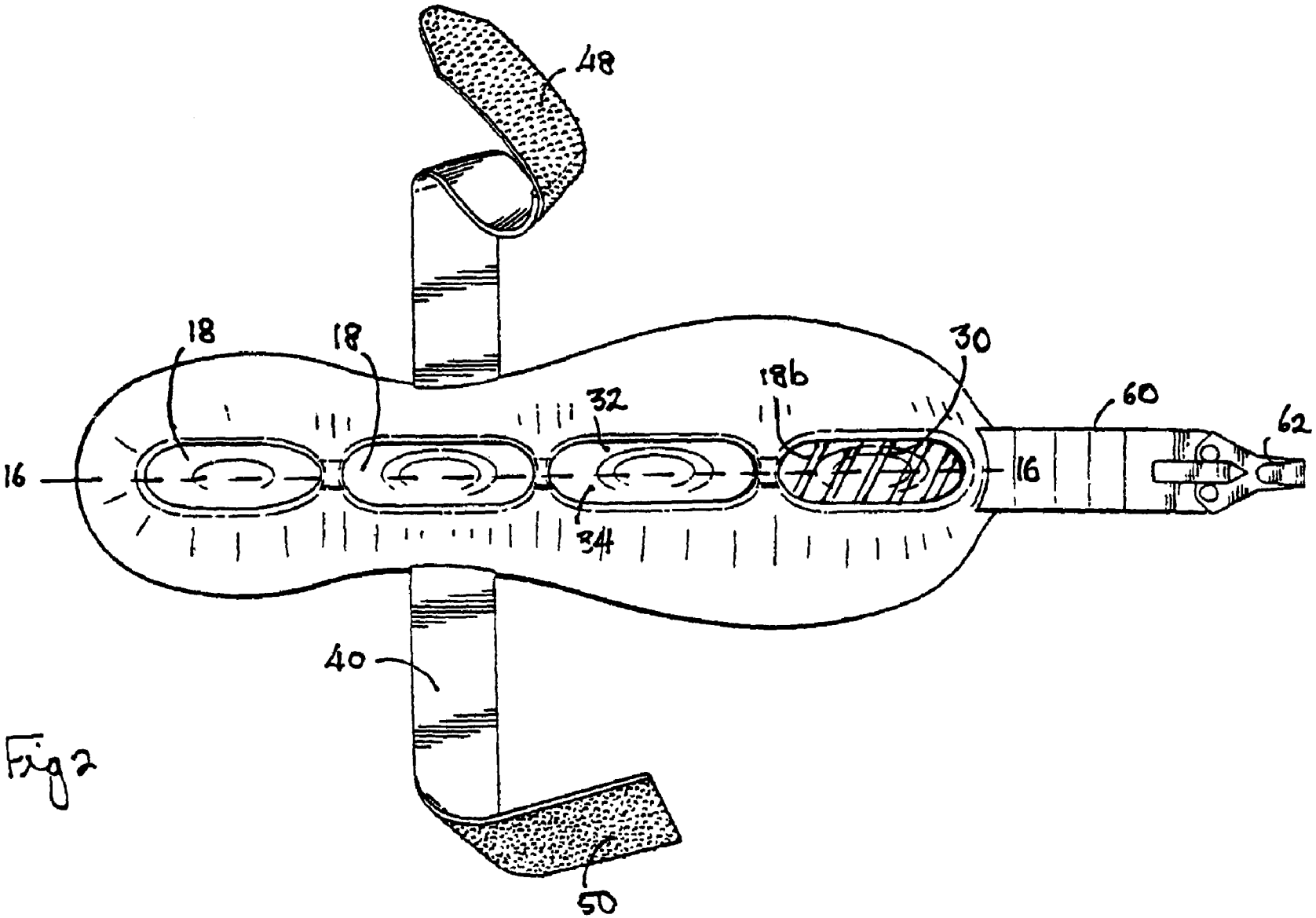
FIG. 2 is a plan view of the body portion in conjunction with a pair of straps for attaching the body portion to an in-line skate.
Figure 3:
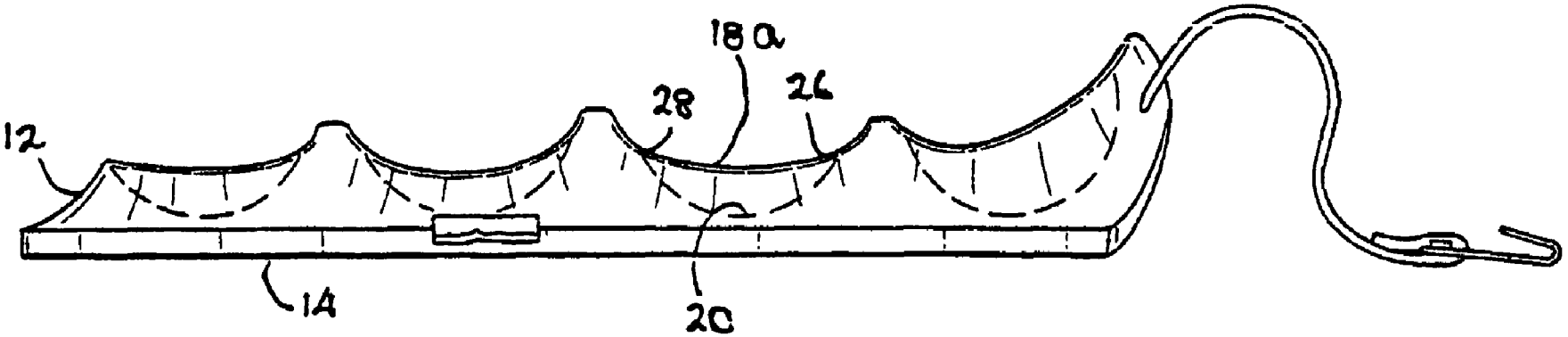
FIG. 3 is an elevation of the body portion and straps.

With reference to FIGS. 1 to 3, the body portion of the guard, generally 10, has oppositely facing upper and lower surfaces 12, 14. The lower surface is adapted to contact the ground while the upper surface has a longitudinal axis 16—16 along which a plurality of wheel-receiving wells 18 are formed. The wells are arranged in an in-line or an end to end configuration.

From the drawings,it will be observed that the body portion is a one-piece continuous unbroken construction having a generally flat lower surface. It will be also observed that the wheel-receiving wells are immovable relative to each other.

Figure 4:
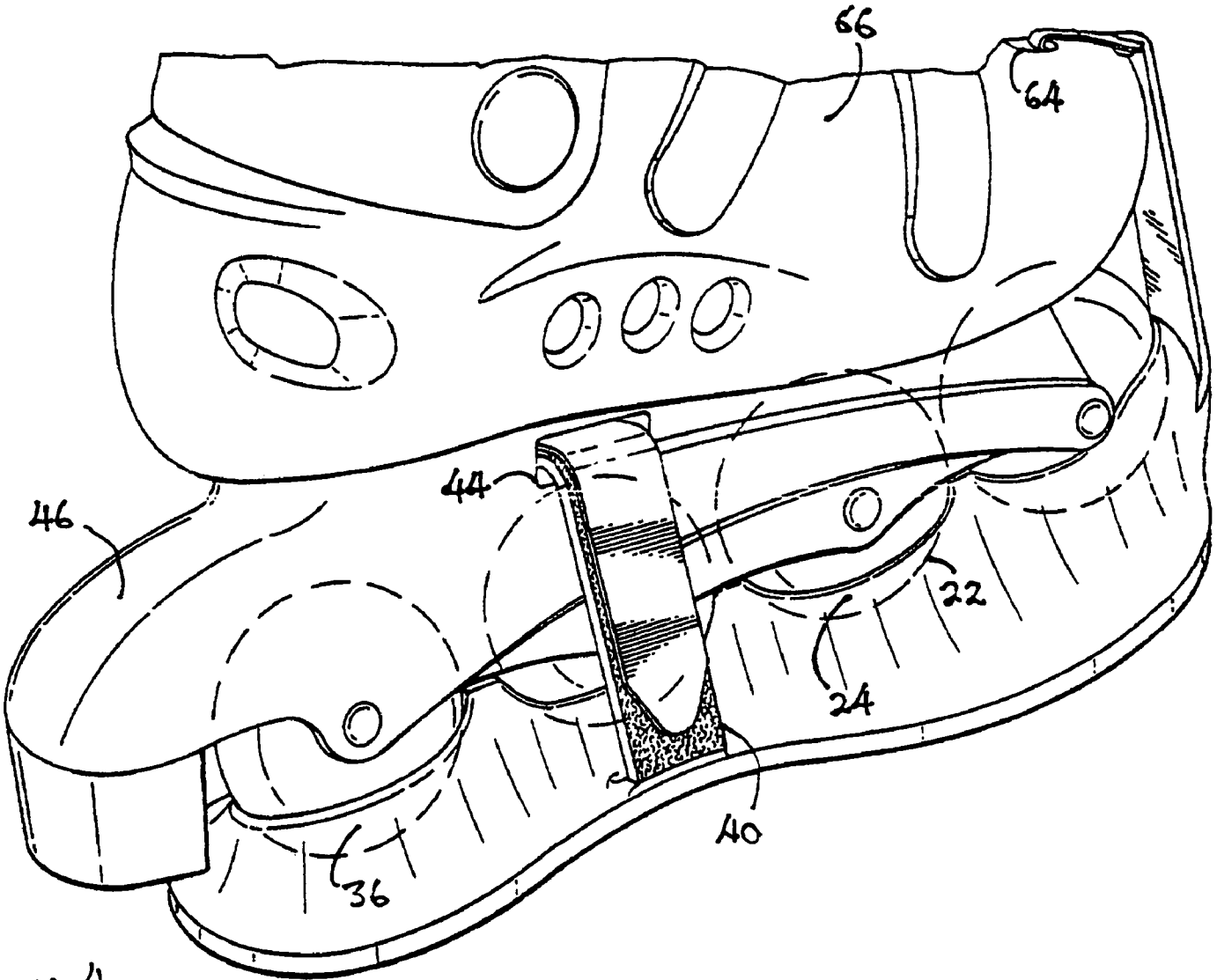
FIG. 4 is a perspective view of the body portion, straps and an in-line skate.

With reference to FIGS. 3 and 4, well 18*a* has a lower wall 20 for gripping a lower substantially continuous portion of the tread 22 of a wheel 24 of an in-line skate. The tread-gripping wall 20 is semi-circular throughout its length and commences at a forward edge 26 extends downwardly from the forward edge and terminates at a rear edge 28. The forward and rear edges are located such as to prevent the wheel from rolling forward or rearward within the well. In other words, the two edges are raised sufficiently that when the skate is moved horizontally to the front or to the rear, the body portion will move with the wheel and will not rotate in the well.

Preferably a plurality of grooves are formed in wall 20 for engaging the circular tread of a wheel of an in-line skate. The grooves are illustrated in well 18*b* in FIG. 2 and are numbered 30. The grooves extend across axis 16—16 preferably at an oblique angle whether acute or obtuse. Each well in the guard is provided with similar grooves.

With reference to FIGS. 2 and 4, the wells have upwardly extending side surfaces 32, 34 on opposite sides of the tread-gripping wall 20 for contacting a lower portion of the side walls 36 of wheel 24. The side surfaces 32, 34 serve to minimize lateral movement of wheel 24 relative to the main body of the guard.

With reference to FIGS. 1, 2 and 4, a first or dorsal strap 40 passes through an opening 42 in the body portion and through an opening 44 in the framework 46 of the in-line skate. Attached to the strap is a Velcro fastener consisting of strips of nylon fabric 48, 50 which are attached to the strap adjacent to its ends. One fabric has loops and the other has burrs and the two strips adhere when pressed together. The strap is used to fasten the body portion of the guard to an in-line skate. To do so, one or both ends of the strap are passed through opening 44 in the framework and by means of the Velcro fastener, the straps are interconnected to prevent the body portion from separating from the skate.

A second or toe strap 60 is attached to the front of the main body. The strap has a hook 62 at its forward end which is connected in a recess 64 on the top wall of the toe portion 66 of the skate when the skate is connected to the guard.

The body portion is composed of moldable material such as neoprene, thermoplastic, urethane, polyvinyl chloride and artificial or natural rubber and preferably the material is somewhat flexible. The base is preferably relatively wide, similar to the width of a shoe, to avoid a feeling of instability or tipping while walking.

The body portion can be molded to the shape of any roller skate. The lengths of such skates generally vary from about 285 mm to about 343 mm and they can be fitted with three, four or five wheels, each of about 64 mm to 88 mm in diameter. In some cases a skate is "rockered" which indicates that there are wheels of different diameters on the same skate. Whatever the size of the skate or the size and configuration of its wheels, the body portion can be molded to accommodate such a skate The fastening means for connecting the dorsal and tow straps to the skate may be, in addition to Velcro, buckles, laces and the like. Preferably, for ease or walking, the straps are somewhat flexible to allow some, but limited, movement between the guard and the skate.

Other modification can be made in the structure of the components of the guard of the invention without departing from the scope and purview of the invention as defined in the appended claims.

I claim:

1. A guard for use in conjunction with an in-line roller skate having a series of wheels which are rotatably mounted along the length of a frame and each of which having a circular tread for contact with the ground and a pair of oppositely facing vertically extending side walls, said guard comprising:

a one piece continuous unbroken main body formed of a moldable material having oppositely facing upper and lower surfaces, said lower surface being generally flat and being adapted to contact the ground and the upper surface having a longitudinal axis along which a plurality of wheel-receiving wells are formed in an in-line configuration, said wheel-receiving wells being immovable relative to each other, at least one of said wells having a wall for gripping a lower substantially continuous portion of the tread of a separate said wheel, said tread gripping wall being semi-circular throughout its length and commencing at a forward edge, extending downwardly from said forward edge and terminating at a rear edge, said forward and rear edges being located such as to prevent said separate wheel from rolling forward or rearward within said at least one well, at least one said well having upwardly extending side surfaces on opposite sides of said tread-gripping wall for contacting a lower portion of the side walls of said separate wheel in order to mininuze lateral movement of said separate wheel relative said main body; and strap means for removably attaching said main body to said skate.

2. The guard of claim 1 wherein said tread-gripping wall has a plurality of grooves formed therein for engaging the circular tread of said separate wheel, said grooves extending laterally across said longitudinal axis.

3. The guard of claim 1 wherein said skate has a toe portion and a dorsal portion, said strap means having a first strap for encircling said dorsal portion and a second strap for attachment to said toe portion.

4. The guard of claim 1 wherein the material of said body portion is flexible.

5. A guard for use in conjunction with an in-line roller skate having a toe portion, a dorsal portion and a series of wheels which are rotatably mounted along the length of a frame and each of which having a circular tread for contact with the ground and a pair of oppositely facing vertically extending side walls, said guard comprising:

a one-piece continuous unbroken main body formed of a moldable, flexible material having oppositely facing upper and lower surfaces, said lower surface being generally flat and being adapted to contact the ground and the upper surface having a longitudinal axis along which a plurality of wheel-receiving wells are formed in an in-line configuration, said wheel-receiving wells being immovable relative to each other, at least one of said wells having a wall for gripping a lower substantially continuous portion of the tread of a separate said wheel, said tread-gripping wall being semi-circular throughout its length and commencing at a forward edge, extending downwardly from said forward edge and terminating at a rear edge, said forward and rear edges being located such as to prevent said separate wheel from rolling forward or rearward within said at least one well, said tread-gripping wall further having a plurality of grooves formed therein for engaging the circular tread of said separate wheel, said grooves extending laterally across said longitudinal axis, at least one said well further having upwardly extending side surfaces on opposite sides of said tread-gripping wall for contacting a lower portion of the side walls of said separate wheel in order to minimize lateral movement of said separate wheel relative to said main body; and strap means for removably attaching said main body to said skate, said strap means having a first strap for encircling said dorsal portion and a second strap for attachment to said toe portion.

* * * * *